US007494570B2

(12) United States Patent
Laari

(10) Patent No.: US 7,494,570 B2
(45) Date of Patent: Feb. 24, 2009

(54) APPARATUS IN A PAPER OR CARDBOARD MACHINE FOR CONFINING THE PULP FLOW FROM THE HEADBOX

(75) Inventor: Aki Laari, Kouvola (FI)

(73) Assignee: Vaahto Oy, Hollola (FI)

( * ) Notice: Subject to any disclaimer, the term of this patent is extended or adjusted under 35 U.S.C. 154(b) by 456 days.

(21) Appl. No.: 11/330,078

(22) Filed: Jan. 12, 2006

(65) Prior Publication Data

US 2006/0162892 A1 Jul. 27, 2006

(30) Foreign Application Priority Data

Jan. 14, 2005 (FI) ..... 20050045

(51) Int. Cl.
*D21F 1/56* (2006.01)
*D21F 1/06* (2006.01)

(52) U.S. Cl. ..... 162/353; 162/354; 162/317

(58) Field of Classification Search ..... 162/195, 162/212, 257, 259, 286, 315, 317, 353, 354, 162/355

See application file for complete search history.

(56) References Cited

U.S. PATENT DOCUMENTS 1,603,226 A * 10/1926 Wentz ..... 162/353
1,679,523 A * 8/1928 Heisel ..... 162/195
6,146,502 A * 11/2000 Marx ..... 162/353

* cited by examiner

*Primary Examiner*—Eric Hug
(74) *Attorney, Agent, or Firm*—Birch, Stewart, Kolasch & Birch, LLP

(57) ABSTRACT

An apparatus in a paper or cardboard machine for confining the pulp flow coming from the headbox (1), said apparatus comprising at least one deckle system, which comprises a deckle part (2) and supporting elements supporting the deckle part, said deckle part being so arranged that in its service position it confines the pulp flow from the headbox in the sideways direction in the edge area of the wire (3). The deckle part (2) has been arranged to be supported so as to be movable in the longitudinal direction of the machine and that the deckle part (2) additionally comprises a mounting point (21) at which the deckle part is (2) secured so that, in the service position, it is substantially immovable at least in the longitudinal direction of the machine.

11 Claims, 6 Drawing Sheets

Det A

Det D

Det E

APPARATUS IN A PAPER OR CARDBOARD MACHINE FOR CONFINING THE PULP FLOW FROM THE HEADBOX

BACKGROUND OF THE INVENTION

The present invention relates to an apparatus in a paper or cardboard machine as defined in the preamble of claim 1 for confining the pulp flow from the headbox, said apparatus comprising at least one deckle system, which comprises a deckle part and supporting elements supporting the deckle part, said deckle part being so arranged that the deckle part in its service position confines the pulp flow from the headbox in the sideways direction in the edge area of the wire.

The apparatus forming the object of the invention is typically referred to as a deckle. Its function is to contain the flow of stock discharged from the headbox slice onto the wire so as to confine the flow in the sideways direction at the edges of the wire. Thus, the aim is to prevent uncontrolled spreading of stock on the wire immediately after the headbox. After the stock has advanced through some distance on the wire in the machine direction and a sufficient amount of water has been removed from it, this problem disappears. A common method of confining the flow of stock in the sideways direction is to use deckles at the edges of the wire immediately after the headbox.

Deckles typically consist of a deckle part and a mechanism supporting it. The deckle part of deckles is traditionally supported by suspending it from above. This involves certain drawbacks, including the fact that during operation the deckle part can be rotated about an axis parallel to the longitudinal direction of the machine due to the pulp pressure, especially with large headbox slice values. In addition, the thermal stress has the effect that the deckle, as seen from above, is bent in the transverse direction of the machine. As a consequence of this, the deckle produces so-called undulations at the edges of the stock web and the web becomes thinner in the edge area due to pulp loss. Traditionally, the deckle end adjacent to the headbox has been provided with adjustments both in a vertical direction and in the longitudinal direction of the machine. After maintenance and a wire change, connecting these fixtures has proved to be a laborious task and the adjustment settings of the deckle in the transverse direction of the machine and in the vertical direction have changed.

Traditional deckle mounting solutions have thus been complicated and/or difficult to adjust. This is a problem especially in conjunction with maintenance and wire changes, because connecting the deckle mounting elements has proved to be a laborious task and additionally the adjustment settings of the deckles in the transverse direction of the machine and in the vertical direction may have changed. Therefore, setting the deckles back to the position in which they were before the maintenance operations is difficult and time-consuming.

The object of the present invention is to achieve a completely new type of solution that will allow problems of prior art to be avoided. Thus, the object of the invention is to create a sturdy deckle solution that can be easily removed from the service position e.g. in connection with maintenance activities or wire changes and returned back to its former position after the maintenance. A further object is to create a deckle mounting solution that fulfills corresponding objectives.

BRIEF DESCRIPTION OF THE INVENTION

The apparatus of the invention is mainly characterized in that the deckle part is arranged to be supported so as to be movable in the longitudinal direction of the machine and that the deckle part additionally comprises a mounting point at which the deckle part is secured so that, in the service position, it is substantially immovable at least in the longitudinal direction of the machine.

The apparatus of the invention is additionally characterized by what is stated in claims 2-12.

The solution of the invention has numerous significant advantages. The mechanical adjustments of the deckle do not change in connection with maintenance and wire change situations. The number of adjustment points has been substantially reduced, so the number of adjustments to be carried out by personnel is minimized. The solution enables an automation system to control the amounts of water flowing in connection with the deckle on a quality-specific basis in accordance with the speed. The apparatus can be easily fastened to the headbox and the fastening can also be automated. The deckle is easy to detach during wire change from the attendance side of the machine. The structure permits different water supply needs at different points of the wire. The deckle is of sturdy construction. The deckle remains straight and does not get twisted and/or curved. This makes it possible to reduce and even completely prevent the formation of undulations at the edges and to reduce the range of grammage variation in the edge areas of the machine. The edge area of reduced grammage is correspondingly made narrower. The runnability of the machine is improved and the width of the pulp web can be increased, thus improving productivity.

BRIEF DESCRIPTION OF THE FIGURES

In the following, the invention will be described in detail with reference to an example and the attached drawing, wherein.

DETAILED DESCRIPTION OF THE INVENTION

Figure 1:
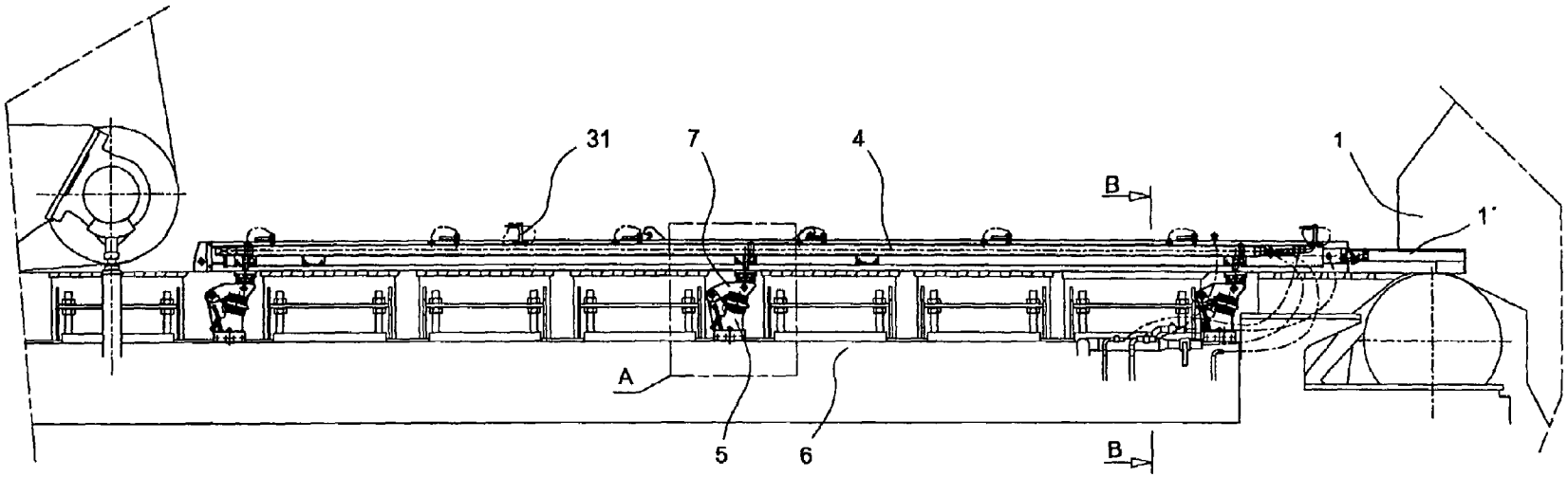
FIG. 1 presents an apparatus according to the invention in side view.
Figure 2:
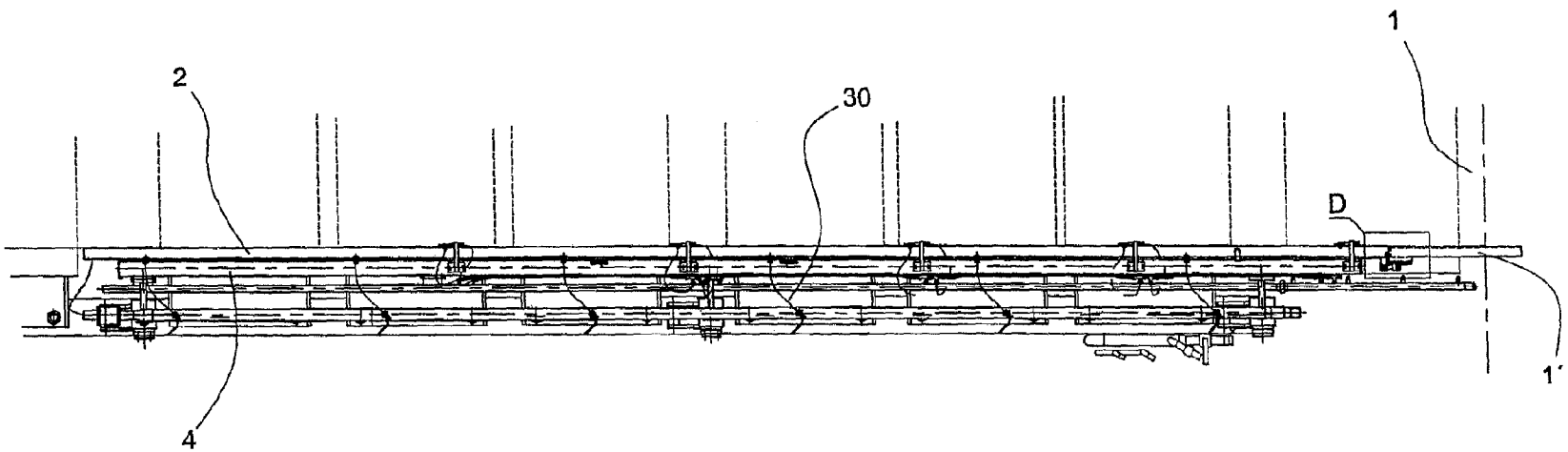
FIG. 2 presents the apparatus of FIG. 1 in top view.
Figure 3:
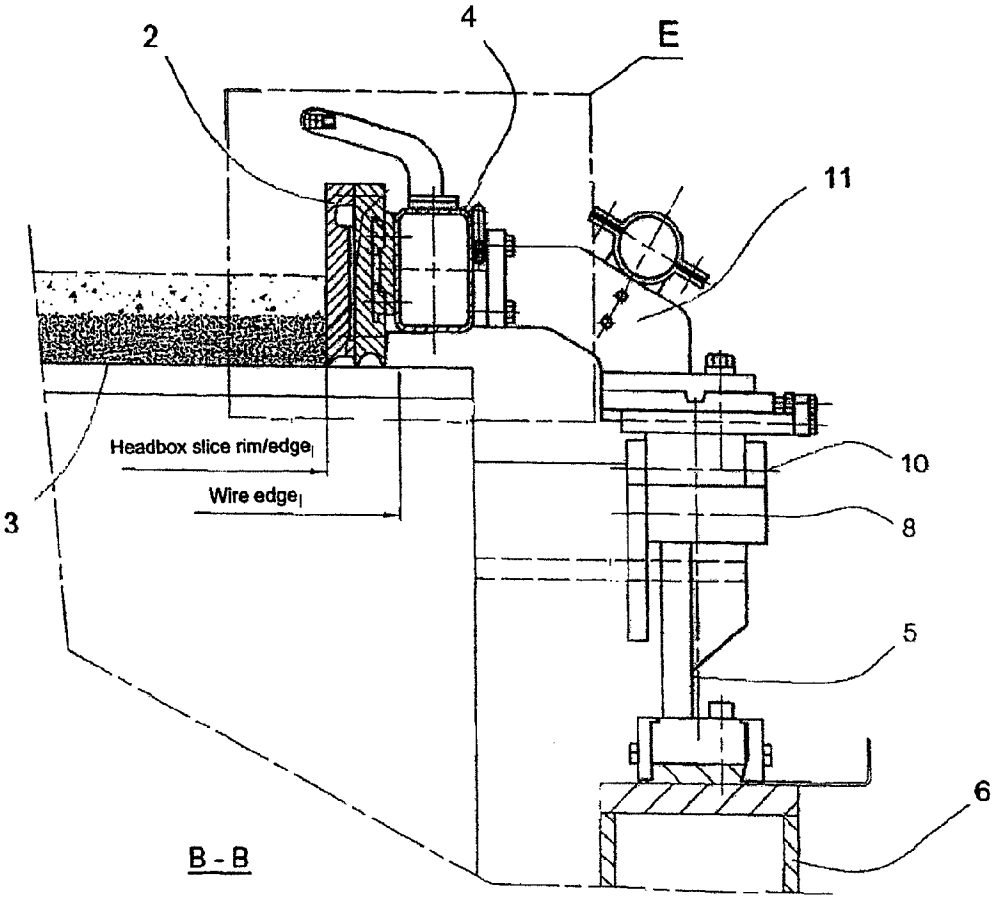
FIG. 3 presents section B-B of FIG. 1 in magnified view.

FIGS. 1 and 2 present an apparatus according to the invention for use in connection with the forming section of a paper machine. The figure shows only one deckle. The forming section is typically provided with two deckles, one on or close to each edge area of the forming section wire.

As stated above, the invention concerns an apparatus in a paper or cardboard machine for confining the pulp flow from the headbox 1, said apparatus comprising at least one deckle system comprising a deckle part 2 and supporting elements for supporting the deckle part, which deckle part is so arranged that, in the service position, it confines the pulp flow from the headbox in the sideways direction in the edge area of the wire 3. The deckle part 2 has been arranged to be movably supported in the longitudinal direction of the machine, and the deckle part 2 additionally comprises a mounting point 21 at which the deckle part is secured so that, in the service position, it is substantially immovable at least in the longitudinal direction of the machine.

According to a preferred embodiment, the mounting point 21, of the deckle part 2 is located at or close to the end adjacent to the headbox 1. The mounting point may thus also be located on a supporting structure 1' on the side of the headbox.

The supporting elements of the deckle comprise a supporting frame 4, on which the deckle part 2 has been arranged to be supported so as to be movable, especially slidable, in the longitudinal direction of the machine. The deckle part is typically provided e.g. with a groove 15, such as a dovetail groove, in which a counterpart 16 on the supporting element 4 has been arranged to fit. Naturally the groove and the counterpart may also be arranged the other way round, in which case the supporting element is provided with a groove and the deckle part with a counterpart. In the embodiment in the figure, the deckle part 2 is supported by the side wall 2' facing away from the pulp web.

The supporting frame 4 of the deckle has been arranged to be movable between at least two positions, a first position, i.e. a service position, in which the deckle confines the pulp flow, and a second position, i.e. a maintenance position, in which position the deckle has been moved upwards at least to a distance from the surface of the wire 3. The figures show the deckle in the service position. The supporting frame 4 has been arranged to be movable between the first position and the second position by at least one actuator 9.

The mechanism that moves the supporting frame 4 typically comprises a supporting part 5 arranged on a machine supporting structure 6 or equivalent, and a first supporting arm 7 arranged on the supporting part 6 so as to be rotatable about an axis 8 transverse to the machine direction, and further an actuator 9 arranged to move the supporting arm 7, the supporting frame 4 being arranged on the supporting arm so as to be rotatable about a second transverse axis 10. This arrangement allows the deckle part to be moved in a direction away from the headbox and upwards from the level of the wire when it is to be moved to the second position. When in the second position, the deckle part 2 has thus been moved in the machine direction away from the headbox 1 and upwards from the level of the wire 3.

Figure 4:
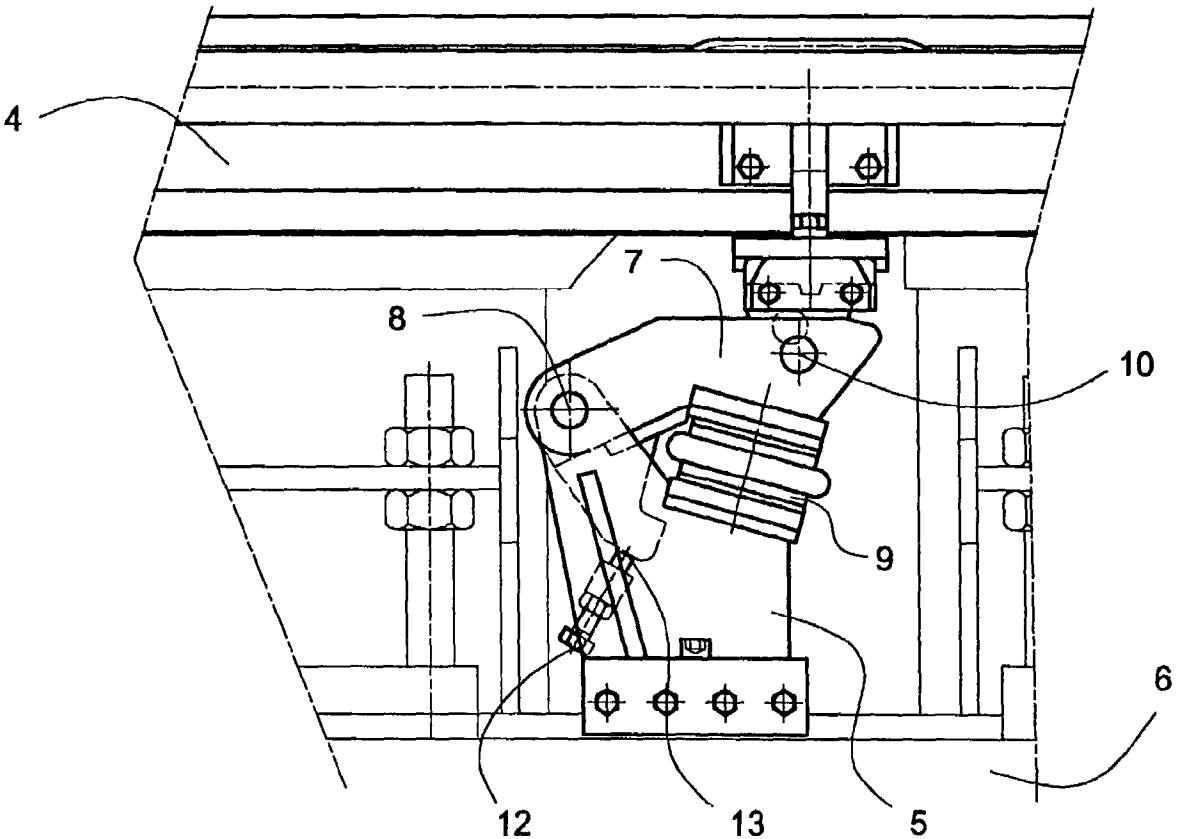
FIG. 4 presents detail A of FIG. 1 in magnified view.
Figure 5:
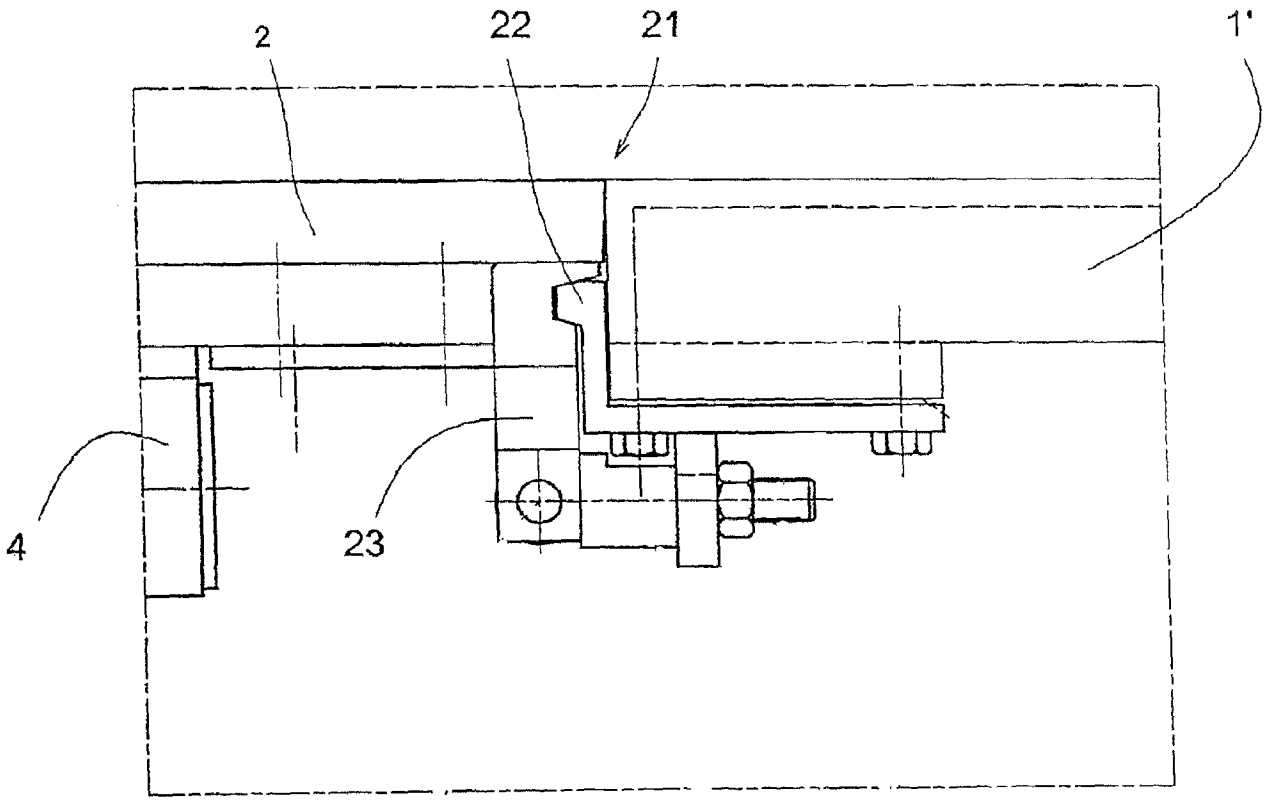
FIG. 5 presents detail D of FIG. 2 in magnified view.
Figure 6:
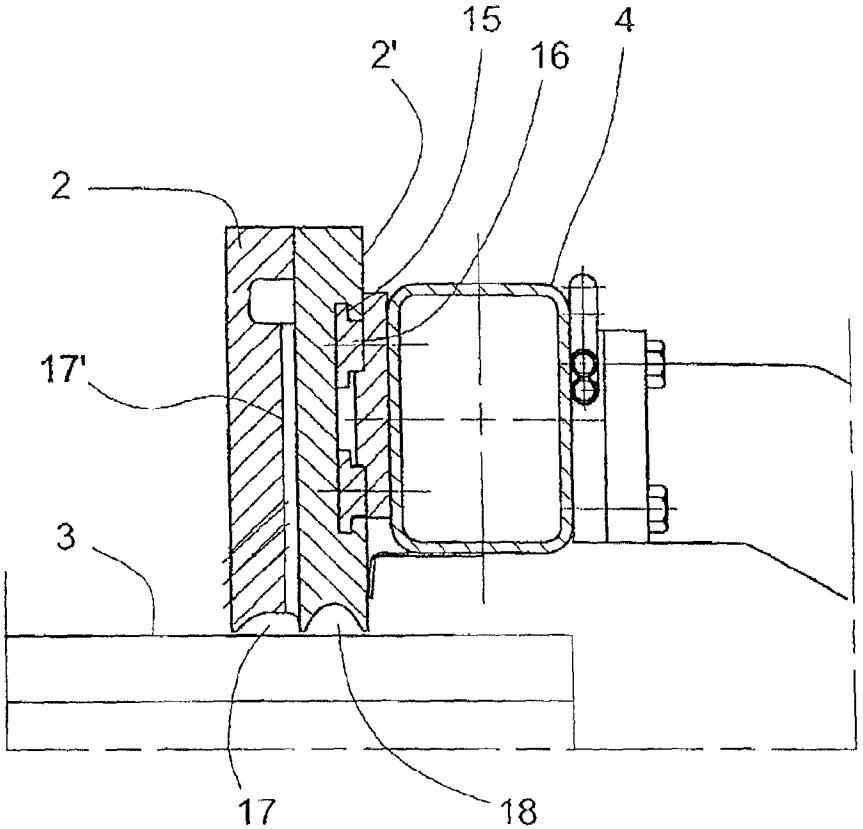
FIG. 6 presents a detail of FIG. 3 in magnified view.

The mechanism moving the supporting frame 4 comprises at least one adjustable stopper part 12 and a stop face 13 for it, said stop face being set against said stopper at least in the service position. In the embodiment in FIG. 4, the stopper part 12 is a screw element.

The apparatus further comprises means for supplying water between the deckle part 2 and the wire 3 when necessary. The deckle part 2 is provided with at least one first longitudinal groove 17 formed in its surface facing towards the wire 3, and a liquid flow passage 17' to said groove is preferably arranged to allow the supply of water from water supply means. The first groove together with the water supply functions as a sealing element, among other things.

Formed in the deckle part 2 surface facing towards the wire 3 is a second longitudinal groove 18, which is located closer to the edge of the wire 3 than the first groove 17. This groove typically serves as a collecting groove for leakage pulp and leakage water, among other things, allowing any pulp and leakage water having drifted into it to move together with the wire away from the area of the forming device.

The mounting point 21 of the deckle part 2 preferably comprises a form-locking joint 22, 23 to allow the deckle part to be locked in the transverse direction as well.

Typically, the fourdrinier wire in the forming section is provided with two deckle mechanisms working independently, one on either side of the machine. Part of the headbox is shown diagrammatically in the figures. Of the forming section, FIG. 1, 2, 3 show some dewatering elements, over which the wire 3 runs. The deckle part 2 of the deckle is preferably only connected to the actuator by the end adjacent to the headbox 1, and therefore longitudinal motion of the machine and variations in temperature distribution along the length of the deckle have no effect on the deformation of the deckle, but being supported in the longitudinal direction of the machine, the deckle can move freely in the machine direction. Longitudinal bearing of the deckle in the height direction of the deckle is so arranged that the deckle can not be twisted about the center of its transverse profile, and thus the web edge being screened remains stable in the upright direction.

The deckle 2 is slidably attached to its supporting elements 4 substantially over the entire length of the deckle 2. The supporting element 4 is secured to the side walls of the headbox 1 or to some other mounting element 1', typically by only one attachment in the longitudinal direction of the machine. The attachment can be easily changed into an automatically operated locking system. In the embodiment illustrated in the figures, the lock is e.g. an eyebolt, which is opened by the operator into the open position before maintenance actions.

In the solution of the invention, the basic settings of the deckle 2 at the end adjacent to the headbox undergo no change after a wire change and a washing shutdown, but the end of the deckle always assumes the same position relative to the headbox 1. The mounting of the deckle at the end adjacent to the headbox only allows vertical motion for adjustment of the gap between the deckle and the wire. In preassembly, the deckle is set in a known manner relative to the side wall of the headbox, and this setting need not be changed during operation. Only a vertical adjustment parameter is determined during the running process. For the duration of the adjustment procedure, the locking of the headbox is loosened and an adjustment is made at the first supporting element. The locking at the end adjacent to the headbox also allows the toe-in of the deckle 2 to be changed in relation to the web. With positive toe-in, the deckle moves away from the web in the direction of motion of the web, and similarly if the toe-in is negative, the deckle approaches the web. In a maintenance situation, the attachment to the headbox also allows the deckle mechanism to move in a direction away from the headbox and simultaneously to move vertically, preferably in a turning movement away from the headbox, and correspondingly in a closing situation, when in the low position, the deckle assumes its position corresponding to the starting situation and is locked in place in the longitudinal direction of the machine. The guide mechanism is preferably a wedge coupling of wedge-like form or having a tread, which guides the parts against each other in the transverse and longitudinal directions of the machine, while the vertical direction is free and is locked by a frictional locking mechanism after the maintenance operation.

The supporting frame 4 is preferably a relatively stiff profiled beam, preferably a tubular beam, having a length at least substantially equal to that of the deckle part 2, the sliding attachment 15, 16 of the deckle 2 being located on a lateral surface of the beam. The supporting frame receives the pressure and flow force components produced by the pulp web. The supporting frame, preferably its beam structure, retains its direction and does not bend laterally or vertically in a sense contrary to the process values. The supporting frame 4 may be arranged or it may form a channel or several channels for conveying lubricating and sealing water to the deckle 2. The supporting frame may be provided with one or more lubricating, sealing or boundary lubrication water lines 30 externally attached to it, and likewise with an external spraying nozzle 31, to allow desired mediums, especially liquid mediums to be applied over the length of the deckle 2, preferably by zones.

The adjustments of the supporting frame 4 are implemented in the space between the supporting frame 4 and a supporting structure, such as a frame beam 6, supporting the wire section. As is known, the frame beam 6 has on its upper side a mounting surface for dewatering elements, and the equipment for moving and adjusting the deckle can be secured to the same mounting surface. The adjusting equipment comprises an actuating mechanism, preferably a lever mechanism 7, 8, 9, 10, by means of which the supporting frame 4 and the deckle part 2 are lifted and moved aside from the attachment to the headbox and from the surface of the wire 3. The upward motion of the lever mechanism 7 and the distance of the deckle from the surface of the wire are limited by a stopper/adjuster 12, 13, preferably adjusting/locking screws. The deckle can be adjusted in a known manner to a somewhat different distance from the wire surface according to the running direction of the web so that the trailing end of the deckle is at a higher position than the end adjacent to the headbox. The deckle 2 can also be held at a constant distance from the wire surface, depending on the other running parameters of the machine. The deckle part can be easily lifted to a maintenance position. This is done especially during washing and wire change. For the time of a wire change, the supporting frame of the deckle can be very easily disengaged from the lever mechanism from the attendance side of the machine and lifted onto the machine aisle by an overhead crane. The hoisting points are located in an advantageous place in the structure and the stiffness of the structure is such that the hoisting action will cause no harm whatsoever to the deckle itself, which is a problem in the case of prior-art mounting mechanisms. When remounted, the parts assume the same positions from which they were released, and therefore changes of personnel will not change the adjustments. The deckle adjustments are only influenced by changes in water flow in the process, and these can be determined on a quality-specific basis for each quality. With the obsolete deckle structure, it has never before been possible to implement this.

The fastening and adjusting mechanisms on the frame 6 of the wire need not be detached, and the deckle on the operating side of the machine need not be loosened in any way from the supporting structure. On the operating side of the machine, only the attachment to the headbox is released and the deckle is lifted up automatically. The actuating mechanism also comprises an actuator 9, which in the embodiment in the figure consists of blowers (in FIGS. 1 and 2, three blowers on either side of the machine). The actuator 9 may be any pressure-medium operated or electric device. The construction typically requires at least one actuator 9 on either side of the machine. Depending on the length of the supporting structure 4, there are at least two mounting points on either side of the machine. The position of the forward end of the deckle 2 relative to the surface of the wire 3 is adjusted by means of the supporting structure adjacent to the headbox 1. The supporting structure is also provided with means for depth-wise adjustment, allowing the distance of the deckle relative to the center line of the machine to be adjusted either to a straight position or to a toe-in position. After the basic adjustments have been made, the machine personnel will not touch the settings, only the water flow values are varied.

The apparatus of the invention can be used in connection with an automatic control system (not shown in the figure). In this case, the construction comprises local control boxes on the attendance and operating side of the machine, not shown in the figure. Moreover, the automation system of the machine contains quality-specific running parameters for the supply of water to the deckle.

It is obvious to the person skilled in the art that the invention is not limited to the embodiments described above, but that it may be varied within the scope of the claims presented below. Features that may have been presented together with other features in the description can also be used separately from each other if necessary.

The invention claimed is:

1. An apparatus in a paper or cardboard machine for confining the pulp flow coming from the headbox, said apparatus comprising at least one deckle system, which comprises a deckle part and supporting elements supporting the deckle part, said deckle part being so arranged that in its service position it confines the pulp flow from the headbox in the sideways direction in the edge area of the wire, wherein the deckle part has been arranged to be supported so as to be movable in the longitudinal direction of the machine and the deckle part additionally comprises a mounting point at which the deckle part is secured so that, in the service position, it is substantially immovable at least in the longitudinal direction of the machine, and wherein the mounting point of the deckle part is located at or close to the end adjacent to the headbox.

2. An apparatus according to claim 1, wherein the supporting elements of the deckle comprise a supporting frame, on which the deckle part has been arranged to be supported so as to be movable, especially slidable, in the longitudinal direction of the machine.

3. An apparatus according to claim 2, wherein the supporting frame of the deckle has been arranged to be movable between at least two positions, a first position, i.e. a service position, in which position the deckle confines the pulp flow, and a second position, i.e. a maintenance position, in which position the deckle has been moved upwards at least to a distance from the surface of the wire.

4. An apparatus according to claim 3, wherein the supporting frame has been arranged to be movable between the first position and the second position at least by an actuator.

5. An apparatus according to claim 4, wherein a mechanism moving the supporting frame comprises a supporting part arranged on a machine supporting structure or equivalent, and a first supporting arm arranged on the supporting part so as to be rotatable about an axis transverse to the machine direction, and further an actuator arranged to move the supporting arm, on which supporting arm the supporting frame has been arranged so as to be rotatable about a second transverse axis.

6. An apparatus according to claim 3, wherein, in the second position, the deckle part has been moved in the machine direction away from the headbox and upwards from the level of the wire.

7. An apparatus according to claim 5, wherein the mechanism moving the supporting frame comprises at least one adjustable stopper part and a stop face for it, said stop face being set against said stopper at least in the service position.

8. An apparatus in a paper or cardboard machine for confining the pulp flow coming from the headbox, said apparatus comprising at least one deckle system, which comprises a deckle part and supporting elements supporting the deckle part, said deckle part being so arranged that in its service position it confines the pulp flow from the headbox in the sideways direction in the edge area of the wire, wherein the deckle part has been arranged to be supported so as to be movable in the longitudinal direction of the machine and the deckle part additionally comprises a mounting point at which the deckle part is secured so that, in the service position, it is substantially immovable at least in the longitudinal direction of the machine, and wherein the apparatus further comprises means for supplying water between the deckle part and the wire.

9. An apparatus in a paper or cardboard machine for confining the pulp flow coming from the headbox, said apparatus comprising at least one deckle system, which comprises a deckle part and supporting elements supporting the deckle part, said deckle part being so arranged that in its service position it confines the pulp flow from the headbox in the sideways direction in the edge area of the wire, wherein the deckle part has been arranged to be supported so as to be movable in the longitudinal direction of the machine and the deckle part additionally comprises a mounting point at which the deckle part is secured so that, in the service position, it is substantially immovable at least in the longitudinal direction of the machine, and wherein the deckle part comprises at least one first longitudinal groove formed in its surface facing towards the wire, to which groove a liquid flow passage has been arranged for the supply of water.

10. An apparatus according to claim 9, further comprising a second longitudinal groove formed in the surface of the deckle part facing towards the wire, said second groove being located closer to the edge of the wire than the first groove.

11. An apparatus in a paper or cardboard machine for confining the pulp flow coming from the headbox, said apparatus comprising at least one deckle system, which comprises a deckle part and supporting elements supporting the deckle part, said deckle part being so arranged that in its service position it confines the pulp flow from the headbox in the sideways direction in the edge area of the wire, wherein the deckle part has been arranged to be supported so as to be movable in the longitudinal direction of the machine and the deckle part additionally comprises a mounting point at which the deckle part is secured so that, in the service position, it is substantially immovable at least in the longitudinal direction of the machine, and wherein the mounting point of the deckle part comprises a form-locking joint to allow the deckle part to be locked in the transverse direction as well.

* * * * *